US011015601B2

(12) United States Patent
Sato et al.

(10) Patent No.: US 11,015,601 B2
(45) Date of Patent: May 25, 2021

(54) SCROLL FLUID MACHINE AND TIP SEAL

(71) Applicant: MITSUBISHI HEAVY INDUSTRIES THERMAL SYSTEMS, LTD., Tokyo (JP)

(72) Inventors: Hajime Sato, Tokyo (JP); Yoshiyuki Kimata, Tokyo (JP); Yohei Hotta, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 214 days.

(21) Appl. No.: 16/311,087

(22) PCT Filed: Aug. 25, 2017

(86) PCT No.: PCT/JP2017/030610
§ 371 (c)(1),
(2) Date: Dec. 18, 2018

(87) PCT Pub. No.: WO2018/043359
PCT Pub. Date: Mar. 8, 2018

(65) Prior Publication Data

US 2020/0309131 A1 Oct. 1, 2020

(30) Foreign Application Priority Data

Aug. 31, 2016 (JP) ..... JP2016-169192

(51) Int. Cl.
*F04C 18/02* (2006.01)
*F04C 27/00* (2006.01)
*F04C 2/02* (2006.01)

(52) U.S. Cl.
CPC ..... *F04C 18/0284* (2013.01); *F04C 2/025* (2013.01); *F04C 18/0215* (2013.01);
(Continued)

(58) Field of Classification Search
CPC ..... F04C 18/0215; F04C 18/0246; F04C 18/0253; F04C 18/0269; F04C 18/0276; F04C 18/0284; F04C 27/005; F04C 2/025
See application file for complete search history.

(56) References Cited

U.S. PATENT DOCUMENTS 10,465,798 B2 * 11/2019 Saso ..... F16J 15/102
2002/0114720 A1 8/2002 Itoh et al.
(Continued)

FOREIGN PATENT DOCUMENTS

CN 1898472 A 1/2007
CN 103321906 A 9/2013
(Continued)

OTHER PUBLICATIONS

Extended European Search Report for European Application No. 17846364.2, dated Feb. 19, 2019.
(Continued)

*Primary Examiner* — Mary Davis
(74) *Attorney, Agent, or Firm* — Birch, Stewart, Kolasch & Birch, LLP

(57) ABSTRACT

The present invention improves performance of a scroll fluid machine by effectively exhibiting a function of a tip seal installed at a tooth tip of a wall body even when a continuous slope is provided to the wall body. A slope in which the distance between opposing surfaces of opposing end plates continuously reduces from the outer peripheral surface toward the inner peripheral surface is provided, and a tip seal (7) that comes into contact with an opposing tooth bottom so as to seal a fluid is provided to a tip seal groove (3*d*) formed at a tooth tip of a wall body (3*b*) corresponding to the slope. A groove bottom (3*d*1) of the tip seal groove (3*d*) is formed into a shape in which the center portion (3*d*2) in the groove width direction deepest. The tip seal (7) is formed such that the center portion (7*a*1), in the width direction, of the bottom
(Continued)

(7*a*) of the tip seal (7) facing the groove bottom (3*d*1) projects farther than both side portions (7*a*2).

9 Claims, 14 Drawing Sheets

(52) U.S. Cl.
CPC ..... *F04C 18/0246* (2013.01); *F04C 18/0253* (2013.01); *F04C 18/0269* (2013.01); *F04C 18/0276* (2013.01); *F04C 27/005* (2013.01)

(56) References Cited

U.S. PATENT DOCUMENTS

| | | | | |
|---|---|---|---|---|
| 2007/0104604 | A1 | 5/2007 | Masuda et al. | |
| 2013/0251576 | A1 | 9/2013 | Hirata et al. | |
| 2019/0113033 | A1* | 4/2019 | Sato | F04C 18/0215 |
| 2019/0120229 | A1* | 4/2019 | Sato | F04C 27/005 |
| 2019/0120230 | A1* | 4/2019 | Sato | F04C 18/0276 |

FOREIGN PATENT DOCUMENTS

| | | | |
|---|---|---|---|
| JP | 5-180177 | A | 7/1993 |
| JP | 5-296168 | A | 11/1993 |
| JP | 9-195958 | A | 7/1997 |
| JP | 2002-70766 | A | 3/2002 |
| JP | 2002-303281 | A | 10/2002 |
| JP | 2009-228476 | A | 10/2009 |
| JP | 2012-215131 | A | 11/2012 |
| JP | 2015-55173 | A | 3/2015 |

OTHER PUBLICATIONS

International Search Report (Form PCT/ISA/210) for International Application No. PCT/JP2017/030610, dated Nov. 14, 2017, with English translation.
Japanese Office Action for Japanese Application No. 2016-169192, dated Dec. 14, 2017, with English translation.
Office Action issued in Chinese Application No. 201780038417.9 dated Aug. 12, 2019 with an English Translation.
English translation of the Written Opinion of the International Searching Authority for international Application No. PCT/JP2017/030610, dated Nov. 14, 2017.

* cited by examiner

SCROLL FLUID MACHINE AND TIP SEAL

TECHNICAL FIELD

The present invention relates to a scroll fluid machine and a tip seal.

BACKGROUND ART

In general, a scroll fluid machine is known, in which a fixed scroll member and an orbiting scroll member each having a spiral wall provided on an end plate mesh with each other so as to perform a revolution orbiting movement and a fluid is compressed or expanded.

As the scroll fluid machine, a so-called stepped scroll compressor which is described in PTL 1 is known. In the stepped scroll compressor, step portions are provided at positions of tooth tip surfaces and tooth bottom surfaces of spiral walls of a fixed scroll and an orbiting scroll in a spiral direction and a height on an outer peripheral side of each wall is higher than a height on an inner peripheral side thereof with each step portion as a boundary. The stepped scroll compressor is compressed (three-dimensionally compressed) not only in a circumferential direction of the wall but also in a height direction thereof, and thus, compared to a general scroll compressor (two-dimensional compression) which does not have the step portion, an amount of displacement increases, and thus, compressor capacity can increase.

CITATION LIST

Patent Literature

[PTL 1] Japanese Unexamined Patent Application Publication No. 2015-55173

SUMMARY OF INVENTION

Technical Problem

However, in the stepped scroll compressor, there is a problem that fluid leakage in the step portion is large. In addition, there is a problem that stress concentrates on base portion of the step portion and strength decreases.

Meanwhile, the inventors are studying to provide a continuously inclined portion instead of the step portion provided on the wall and the end plate.

A groove portion for receiving a tip seal is formed on a tooth tip, which is a tip of the wall, along a spiral direction of the wall. During an operation of the scroll compressor, the tip seal comes into contact with a tooth bottom facing the tooth tip while sliding on the tooth bottom, and thus, a fluid leakage is suppressed. In this case, the tip seal is biased toward the tooth bottom side by a fluid entering a groove bottom side of the groove portion.

The groove bottom of the groove portion formed on the tooth tip of the wall corresponding to the inclined portion has a shape in which a center in a groove width direction is deepest. This is because semicircular contour lines are formed with both side portions in the width direction of the groove portion as contact points when the groove bottom which is the inclined portion is processed by a cutting tool such as an end mill having a diameter equivalent to a groove width of the groove portion. In this way, if the deepest center portion is formed on the groove bottom, a clearance between the center portion of the groove bottom and the bottom portion of the tip seal becomes a fluid leakage clearance, and thus, there is a concern that performance of the scroll compressor is reduced.

In addition, a groove portion formed in the tooth tip is inclined in a wall height direction according to the inclined portion of the wall, the shape of the tip seal is changed in the wall height direction. If the shape which is changed according to the inclined portion is applied to the tip seal, there is a concern that the tip seal deteriorates or is damaged.

The present invention is made in consideration of the above-described circumstances, and an object thereof is to provide a scroll fluid machine and a tip seal capable of effectively exerting a function of the tip seal installed on the tooth tip of the wall even in a case where the continuous inclined portion is provided in the wall and improving performance of the tip seal.

Solution to Problem

In order to achieve the above-described object, a scroll fluid machine and a tip seal of the present invention adopt the following means.

According to a first aspect of the present invention, there is provided a scroll fluid machine including: a first scroll member in which a spiral first wall is provided on a first end plate; a second scroll member in which a spiral second wall is provided on a second end plate disposed to face the first end plate and the second wall meshes with the first wall such that the second scroll member performs a revolution orbiting movement relative to the first scroll member; and an inclined portion in which an inter-facing surface distance between the first end plate and the second end plate facing each other continuously decreases from outer peripheral sides of the first wall and the second wall toward inner peripheral sides thereof, in which a groove portion formed on a tooth tip of each of the first wall and the second wall corresponding to the inclined portion is provided with a tip seal which comes into contact with a facing tooth bottom so as to seal a fluid, a groove bottom of the groove portion has a shape in which a center portion in a groove width direction is deepest, and a center portion of the tip seal in a width direction of a tip seal bottom portion facing the groove bottom protrudes from both side portions of the tip seal.

The inclined portion is provided in which the inter-facing surface distance between the first end plate and the second end plate continuously decreases from outer peripheral side of the wall toward inner peripheral side thereof. Accordingly, as a fluid sucked from the outer peripheral side flows toward the inner peripheral side, the fluid not only is compressed by a decrease of a compression chamber according to a spiral shape of the wall but also is further compressed by a decrease of the inter-facing surface distance between the end plates.

The groove bottom of the groove portion formed on the tooth tip corresponding to the inclined portion has the shape (for example, an arc shape) in which the center in the groove width direction is deepest. This is because semicircular contour lines are formed with both side portions in the width direction of the groove portion as contact points when the groove bottom which is the inclined portion is processed by a cutting tool such as an end mill having a diameter equivalent to a groove width of the groove portion. In this way, if the deepest center portion is formed on the groove bottom, there is a concern that a clearance between the center portion of the groove bottom and the bottom portion of the tip seal becomes a fluid leakage clearance. Therefore, according to the tip seal in which the center portion in the width direction of the tip seal bottom portion protrudes from both side portions, the clearance between the center portion in the width direction of the groove bottom and the center portion in the width direction of the tip seal bottom portion decreases. Accordingly, a fluid leakage decreases, a function of the tip seal is effectively exerted, and it is possible to improve performance of the scroll fluid machine.

In addition, in the scroll fluid machine according to the first aspect of the present invention, in a case where an inclination in a spiral direction of the inclined portion is defined as $\varphi$ and a groove width of the groove portion is defined as Tg, a protrusion amount $\Delta h$ of the center portion of the tip seal with respect to both side portions of the tip seal is $(Tg/2)\times\tan\varphi$.

If the inclination in the spiral direction of the inclined portion is defined as $\varphi$ and the groove width of the groove portion is defined as Tg, the depression amount of the center portion of the groove portion with respect to both side portions is $(Tg/2)\times\tan\varphi$. The protrusion amount $\Delta h$ of the center portion of the tip seal is set to have the same dimension as the depression amount, and thus, the clearance between the tip seal bottom portion and the groove bottom can be made as small as possible.

Moreover, in the scroll fluid machine according to the first aspect of the present invention, a wall flat portion whose height is not changed is provided in an outermost peripheral portion and/or an innermost peripheral portion of each of the first wall and the second wall, an end plate flat portion corresponding to the wall flat portion is provided in each of the first end plate and the second end plate, the groove bottom of the groove portion corresponding to the end plate flat portion is a flat surface, and in the tip seal corresponding to the end plate flat portion, the tip seal bottom portion is a flat surface.

The groove bottom corresponding to the wall flat portion is a flat surface, and, according to this, the bottom portion of the tip seal corresponding to the end plate flat portion also is a flat surface. Accordingly, the clearance between the groove bottom and the tip seal bottom portion decreases, and the fluid leakage can be reduced.

In addition, in the scroll fluid machine according to the first aspect of the present invention, the tip seal is divided at a predetermined position in the spiral direction.

The tip seal is divided at the predetermined position in the spiral direction, and thus, it is possible to flexibly cope with the shape changed in the height direction by the inclined portion. Accordingly, the function of the tip seal is effectively exerted, and it is possible to improve the performance of the scroll fluid machine.

For example, the tip seal is divided into a plurality of portions at a position corresponding to the inclined portion, and thus, a deformation amount in a height direction of each divided tip seal can decrease. In this case, a so-called two-dimensional shaped tip seal can be adopted, in which a shape changed in a height direction in advance is not applied to each divided tip seal and each divided tip seal is flat.

In addition, in a case where the wall flat portion is provided, preferably, the tip seal is divided at a position at which the wall flat portion and the inclined portion are connected to each other. Accordingly, the tip seal can be prevented from being damaged at a position at which the inclination is abruptly changed.

Moreover, according to a second aspect of the present invention, there is provided a tip seal which is installed in a groove portion formed on a tooth tip of a spiral wall of a scroll fluid machine, in which the wall includes an inclined portion whose height is continuously changed in a spiral direction, a groove bottom of the groove portion has a shape in which a center portion in a width direction is deepest, and in a bottom portion of the tip seal facing the groove bottom, a center portion in a groove width direction protrudes from both side portions.

The bottom portion of the tip seal has the shape in which the center portion in the width direction protrudes from both side portions. Accordingly, in a case where the tip seal has the shape in which the center portion in the groove width direction of the groove bottom is deepest, it is possible to decrease the clearance between the bottom portion of the tip seal and the groove bottom.

In addition, according to a third aspect of the present invention, there is provided tip seal which is installed in a groove portion formed on a tooth tip of a spiral wall of a scroll fluid machine, in which the wall includes an inclined portion whose height is continuously changed in a spiral direction, a groove bottom of the groove portion has a shape in which a center portion in a width direction is deepest, and the tip seal is divided at a predetermined position in the spiral direction.

The tip seal is divided at the predetermined position in the spiral direction, and thus, it is possible to decrease a deformation amount of each divided tip seal.

For example, the wall inclined portion whose height is continuously changed in the spiral direction is provided, and thus, the tip seal is disposed so as to follow a change in the height of the wall. In this case, the tip seal is divided in the spiral direction, and thus, it is possible to decrease a change amount of each divided tip seal in the height direction.

In addition, in a case where the wall flat portion connected to the wall inclined portion is provided, preferably, the tip seal is divided at a position at which the wall flat portion and the inclined portion are connected to each other. Accordingly, the tip seal can be prevented from being damaged at a position at which the inclination is abruptly changed.

Advantageous Effects of Invention

According to the tip seal in which the center portion in the width direction of the tip seal bottom portion protrudes from both side portions, the clearance between the center portion in the width direction of the groove bottom and the center portion in the width direction of the tip seal bottom portion decreases, and thus, a fluid leakage decreases, a function of the tip seal is effectively exerted, and it is possible to improve performance of the fluid machine.

In addition, the tip seal is divided at the predetermined position in the spiral direction, and thus, it is possible to flexibly cope with the shape changed in the height direction by the inclined portion, the function of the tip seal is effectively exerted, and it is possible to improve the performance of the scroll fluid machine.

BRIEF DESCRIPTION OF DRAWINGS

FIG. 1A is a longitudinal section view, and FIG. 1B is a plan view when the fixed scroll is viewed from a wall side.

FIG. 7A is a side view showing a state where the tip seal clearance relatively decreases, and FIG. 7B is a side view showing a state where the tip seal clearance relatively increases.

FIG. 10A is a plan view of the tooth tip of the wall, and FIG. 10B is a side view thereof.

FIG. 14A is a longitudinal section view showing a combination with a scroll which does not have a step portion, and FIG. 14B is a longitudinal section view showing a combination with a stepped scroll.

DESCRIPTION OF EMBODIMENTS

Hereinafter, an embodiment according to the present invention will be described with reference to the drawings.

Figure 1A:
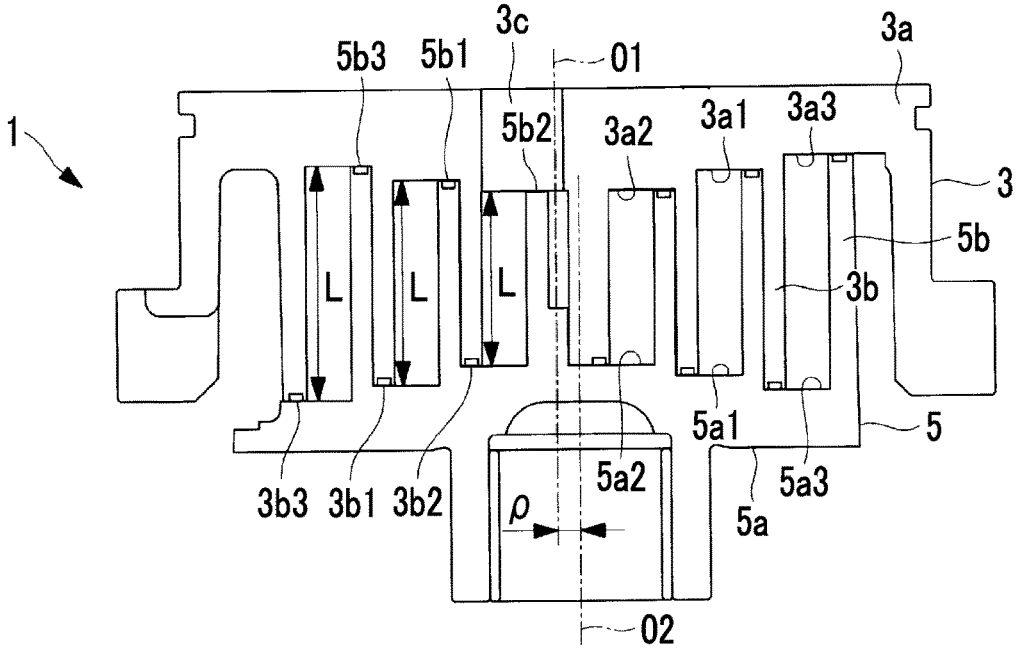
FIGS. 1A and 1B show a fixed scroll and an orbiting scroll of a scroll compressor according to an embodiment of the present invention.
Figure 1B:
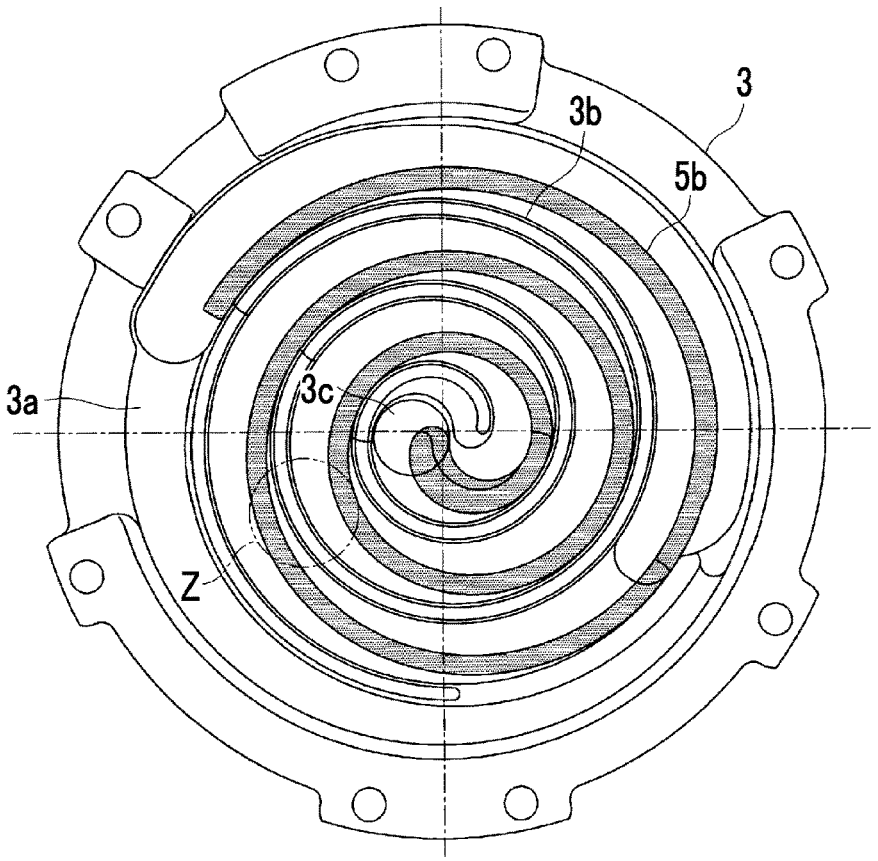

In FIGS. 1A and 1B, a fixed scroll (first scroll member) 3 and an orbiting scroll (second scroll member) 5 of a scroll compressor (scroll fluid machine) 1 are shown. For example, the scroll compressor 1 is used as a compressor which compresses a gas refrigerant (fluid) which performs a refrigerating cycle of an air conditioner or the like.

Each of the fixed scroll 3 and the orbiting scroll 5 is a metal compression mechanism which is formed of an aluminum alloy or steel, and is accommodated in a housing (not shown). The fixed scroll 3 and the orbiting scroll 5 suck a fluid, which is introduced into the housing, from an outer peripheral side, and discharge the compressed fluid from a discharge port 3*c* positioned at a center of the fixed scroll 3 to the outside.

The fixed scroll 3 is fixed to the housing, and as shown in FIG. 1A, includes an approximately disk-shaped end plate (first end plate) 3*a*, and a spiral wall (first wall) 3*b* which is erected on one side surface of the end plate 3*a*. The orbiting scroll 5 includes an approximately disk-shaped end plate (second end plate) 5*a* and a spiral wall (second wall) 5*b* which is erected on one side surface of the end plate 5*a*. For example, a spiral shape of each of the walls 3*b* and 5*b* is defined by using an involute curve or an Archimedes curve.

The fixed scroll 3 and the orbiting scroll 5 are assembled to each other such that centers thereof are separated from each other by an orbiting radius ρ, the walls 3*b* and 5*b* mesh with each other with phases deviated from each other by 180°, and a slight clearance (tip clearance) in a height direction is provided between tooth tips and tooth bottoms of the walls 3*b* and 5*b* of both scrolls. Accordingly, a plurality pairs of compression chambers which are formed to be surrounded by the end plates 3*a* and 5*a* and the walls 3*b* and 5*b* are symmetrically formed about a scroll center between both scrolls 3 and 5. The orbiting scroll 5 performs a revolution orbiting movement around the fixed scroll 3 by a rotation prevention mechanism such as an Oldham ring (not shown).

As shown in FIG. 1A, an inclined portion is provided, in which an inter-facing surface distance L between both end plates 3*a* and 5*a* facing each other continuously decrease from an outer peripheral side of each of the spiral walls 3*b* and 5*b* toward an inner peripheral side thereof.

Figure 2:
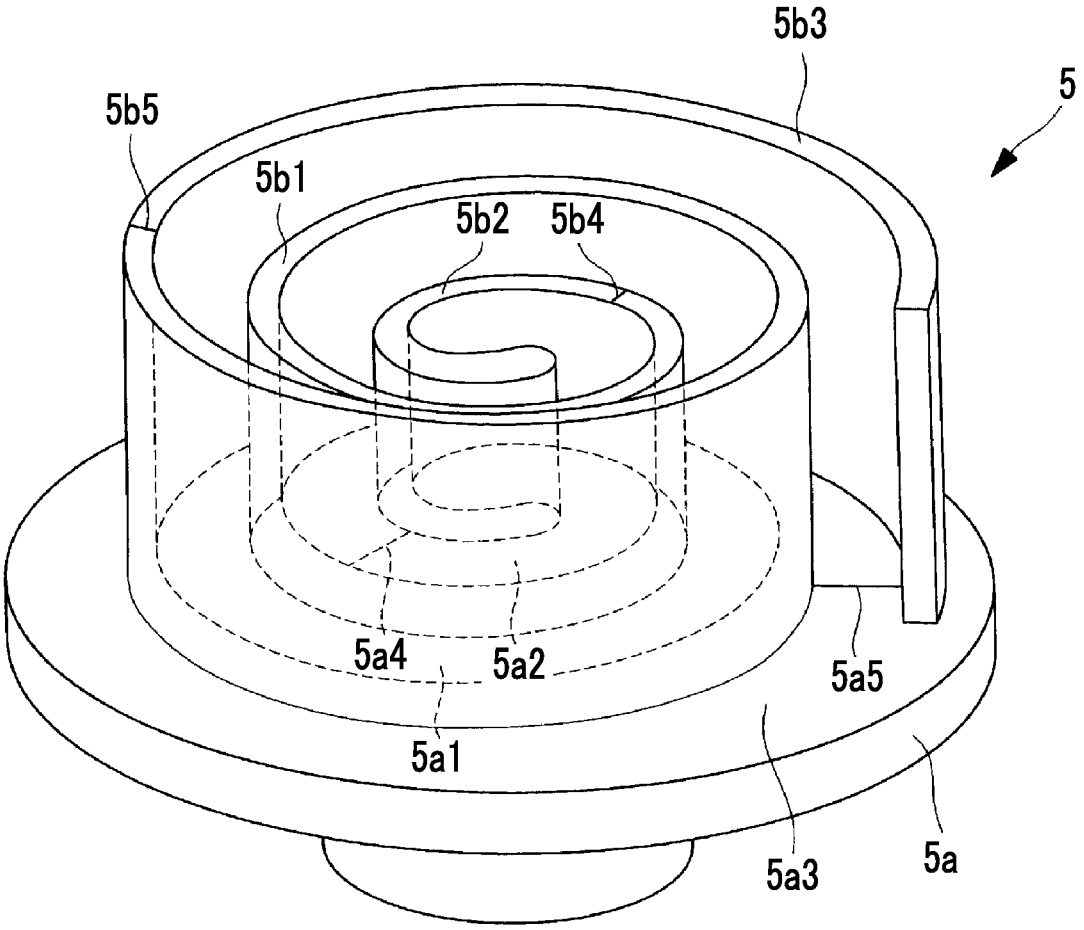
FIG. 2 is a perspective view showing the orbiting scroll of FIGS. 1A and 1B.

As shown in FIG. 2, in the wall 5*b* of the orbiting scroll 5, a wall inclined portion 5*b*1 whose height continuously decreases from an outer peripheral side toward an inner peripheral side is provided. In a tooth bottom surface of the fixed scroll 3 facing a tooth tip of the wall inclined portion 5*b*1, an end plate inclined portion 3*a*1 (refer to FIG. 1A) which is inclined according to an inclination of the wall inclined portion 5*b*1 is provided. A continuously inclined portion is formed by the wall inclined portion 5*b*1 and the end plate inclined portion 3*a*1. Similarly, a wall inclined portion 3*b*1 whose height is continuously inclined from the outer peripheral side toward the inner peripheral side is provided on the wall 3*b* of the fixed scroll 3, and an end plate inclined portion 5*a*1 facing a tooth tip of the wall inclined portion 3*b*1 is provided on the end plate 5*a* of the orbiting scroll 5.

In addition, the meaning of the continuity in the inclined portion in the present embodiment is not limited to a smoothly connected inclination but also includes an inclined portion in which small step portions inevitably generated during processing are connected to each other in a stepwise fashion and the inclined portion is continuously inclined as a whole. However, the inclined portion does not include a large step portion such as a so-called stepped scroll.

Coating is applied to the wall inclined portions 3*b*1 and 5*b*1 and/or the end plate inclined portions 3*a*1 and 5*a*1. For example, the coating includes manganese phosphate processing, nickel phosphorus plating, or the like.

As shown in FIG. 2, wall flat portions 5*b*2 and 5*b*3 each having a constant height are respectively provided on the innermost peripheral side and the outermost peripheral side of the wall 5*b* of the orbiting scroll 5. Each of the wall flat portions 5*b*2 and 5*b*3 is provided over a region of 180° around a center O2 (refer to FIG. 1A) of the orbiting scroll 5. Wall inclined connection portions 5*b*4 and 5*b*5 which become curved portions are respectively provided at positions at which the wall flat portions 5*b*2 and 5*b*3 and the wall inclined portion 5*b*1 are connected to each other.

Similarly, in the tooth bottom of the end plate 5*a* of the orbiting scroll 5, end plate flat portions 5*a*2 and 5*a*3 each having a constant height are provided. Each of the end plate flat portions 5*a*2 and 5*a*3 is provided over a region of 180° around the center of the orbiting scroll 5. End plate inclined connection portions 5*a*4 and 5*a*5 which become curved portions are respectively provided at positions at which the end plate flat portions 5*a*2 and 5*a*3 and the end plate inclined portion 5*a*1 are connected to each other.

Figure 3:
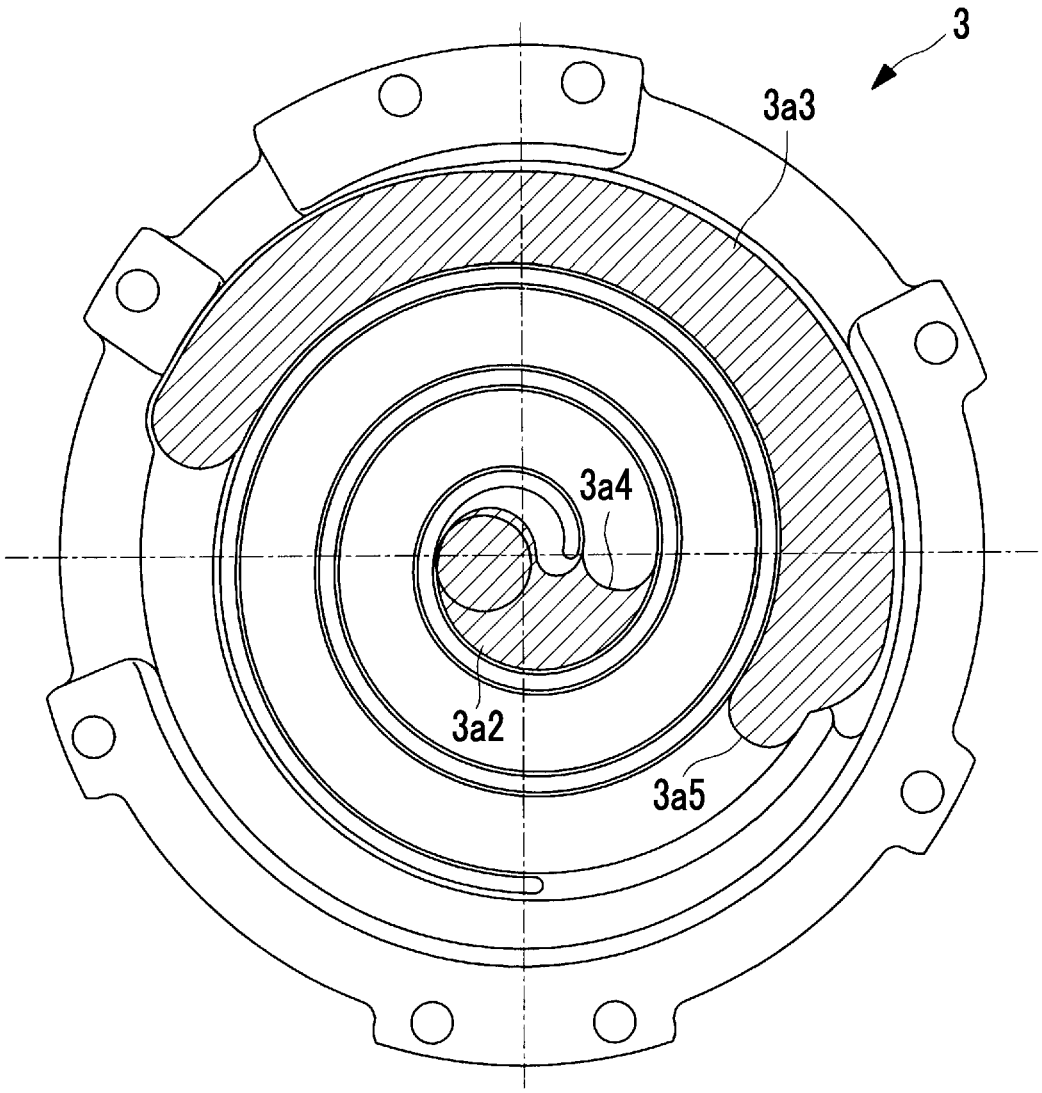
FIG. 3 is a plan view showing an end plate flat portion provided in the fixed scroll.
Figure 4:
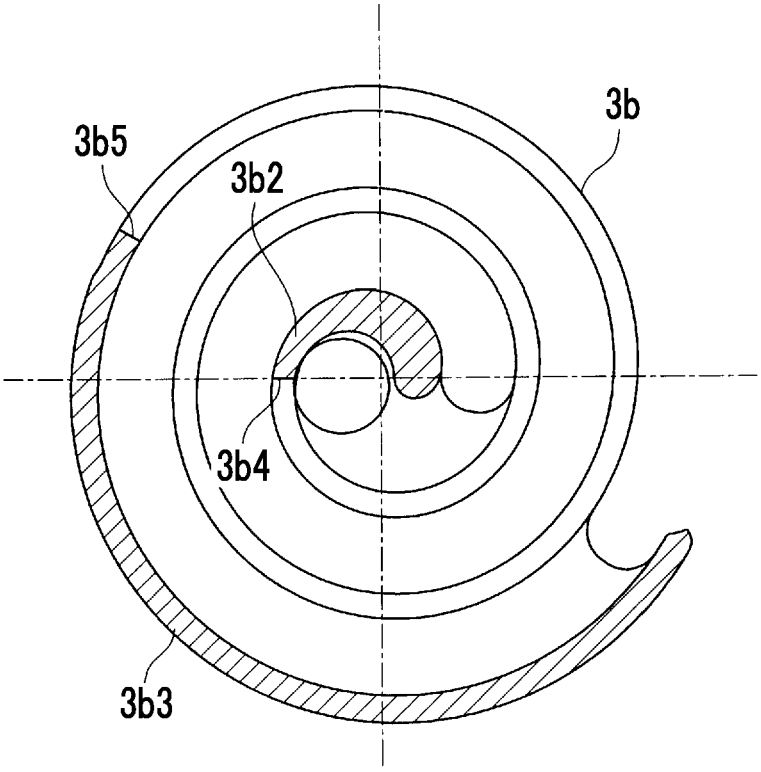
FIG. 4 is a plan view showing a wall flat portion provided in the fixed scroll.

As shown by hatching in FIGS. 3 and 4, similarly to the orbiting scroll 5, in the fixed scroll 3, end plate flat portions 3*a*2 and 3*a*3, wall flat portions 3*b*2 and 3*b*3, end plate inclined connection portions 3*a*4 and 3*a*5, and wall inclined connection portions 3*b*4 and 3*b*5 are provided.

Figure 5:
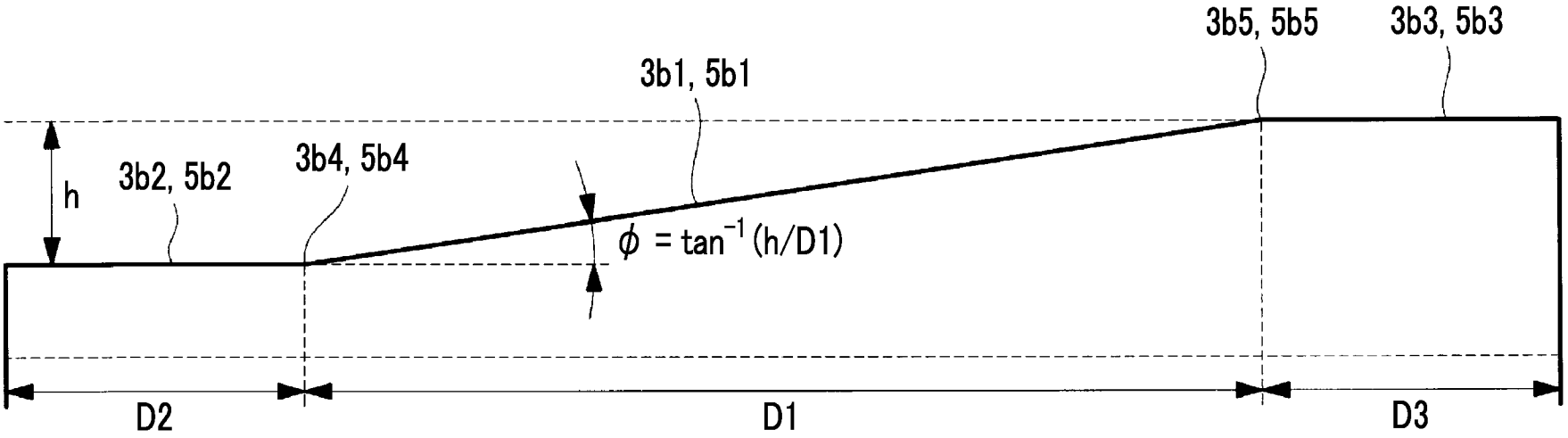
FIG. 5 is a schematic view showing a wall which is displayed to extend in a spiral direction.

FIG. 5 shows the walls 3*b* and 5*b* which are displayed to extend in a spiral direction. As shown in FIG. 5, the wall flat portions 3*b*2 and 5*b*2 on the innermost peripheral side are provided over a distance D2, and the wall flat portions 3*b*3 and 5*b*3 on the outermost peripheral side are provided over a distance D3. Each of the distance D2 and the distance D3 is a length corresponding to the region which becomes 180° around each of the centers a O1 and O2 of the respective scrolls 3 and 5. The wall inclined portions 3b1 and 5b1 are provided over the distance D1 between the wall flat portions 3b2 and 5b2 on the innermost peripheral side and the wall flat portions 3b3 and 5b3 on the outermost peripheral side. If a height difference between each of the wall flat portions 3b2 and 5b2 on the innermost peripheral side and each of the wall flat portions 3b3 and 5b3 on the outermost peripheral side is defined as h, an inclination of each of the wall inclined portions 3b1 and 5b1 is represented by the following Expression.

$$\varphi=\tan^{-1}(h/D1) \quad (1)$$

In this way, the inclination φ of the inclined portion constant in a circumferential direction in which each of the spiral walls 3b and 5b extends.

Figure 6:
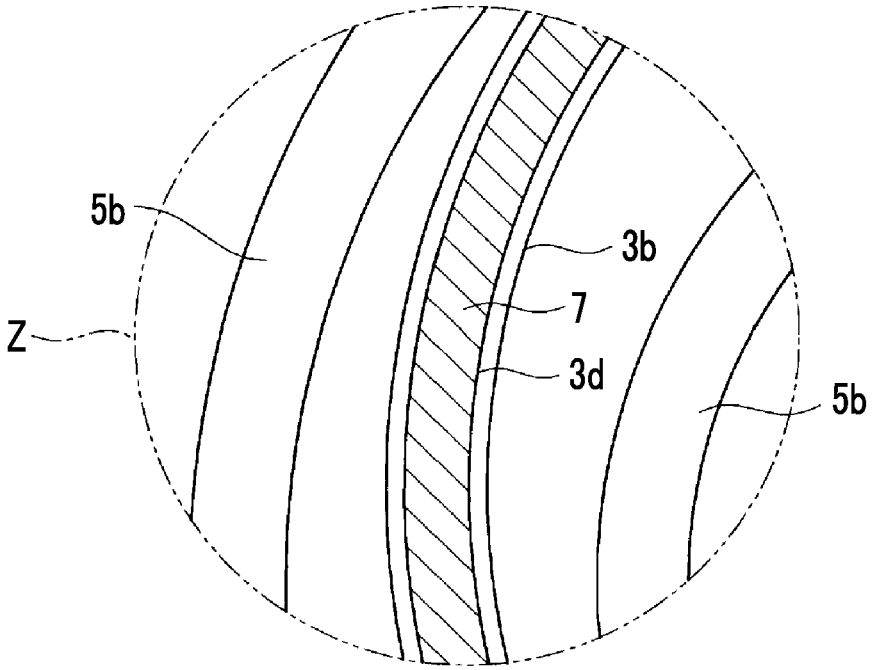
FIG. 6 is a partially enlarged view showing a region indicated by a reference numeral Z in FIG. 1B in an enlarged manner.

FIG. 6 is an enlarged view showing a region indicated by a reference numeral Z in FIG. 1B in an enlarged manner. As shown FIG. 6, a tip seal 7 is provided in the tooth tip of the wall 3b of the fixed scroll 3. The tip seal 7 is formed of a resin and comes into contact with the tooth bottom of the end plate 5a of the facing orbiting scroll 5 so as to seal a fluid. The tip seal 7 is accommodated in a tip seal groove 3d which is formed on the tooth tip of the wall 3b in the circumferential direction. A compressed fluid enters the tip seal groove 3d, presses the tip seal 7 from a rear surface thereof to push the tip seal 7 toward the tooth bottom side, and thus, the tip seal 7 comes into contact with the facing the tooth bottom. In addition, a tip seal is also provided in the tooth tip of the wall 5b of the orbiting scroll 5.

Figure 7A:
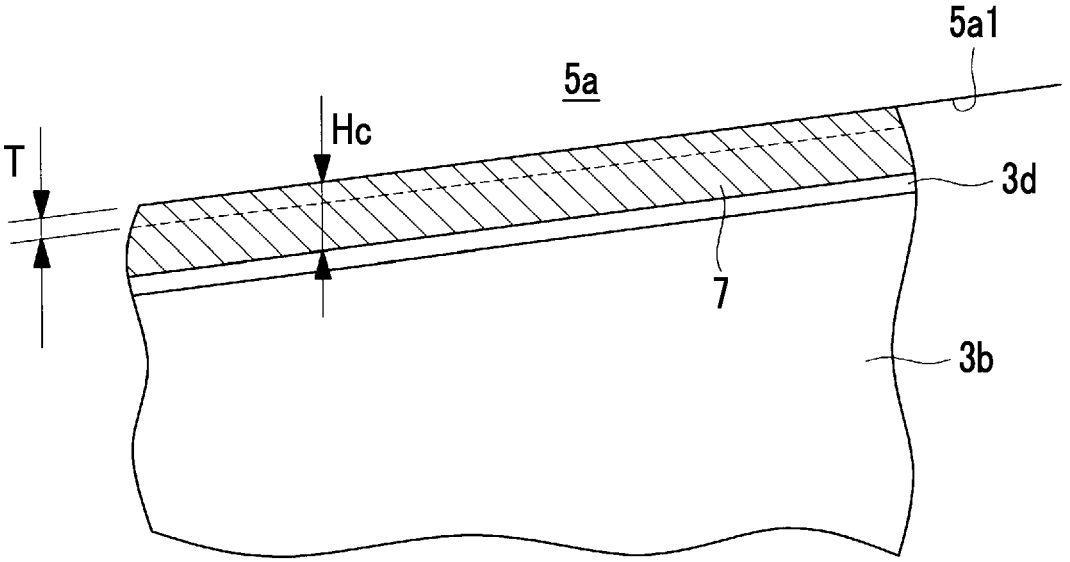
FIGS. 7A and 7B show a tip seal clearance of a portion shown in FIG. 6.
Figure 7B:
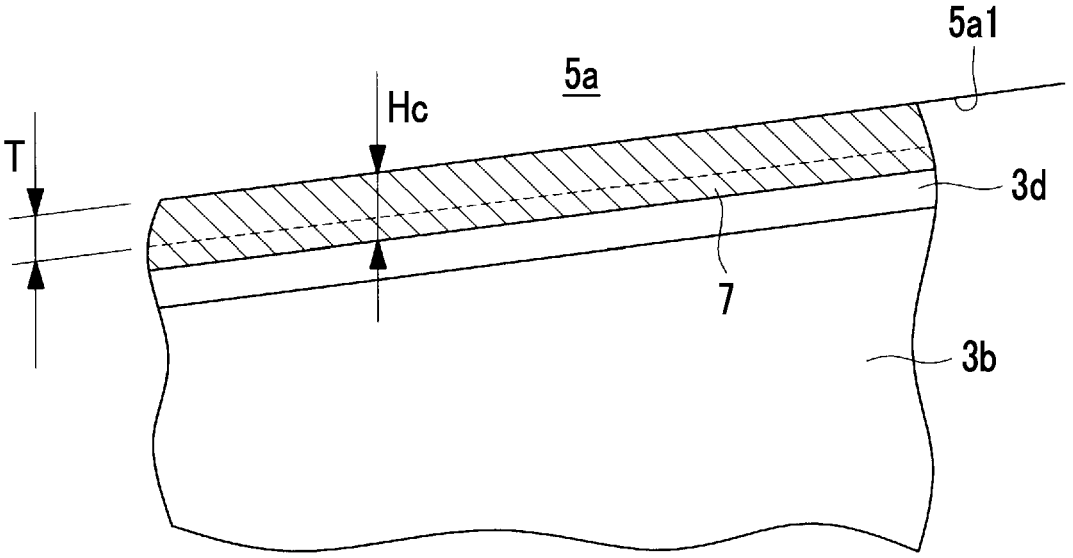

As shown in FIGS. 7A and 7B, a height Hc of the tip seal 7 in the height direction of the wall 3b is constant in the circumferential direction.

If both the scrolls 3 and 5 perform the revolution orbiting movement relative to each other, the positions of the tooth tip and the tooth bottom are relatively deviated by an orbiting diameter (orbiting radius ρ×2). In the inclined portion, the tip clearance between the tooth tip and the tooth bottom is changed due to the positional deviation between the tooth tip and the tooth bottom. For example, in FIG. 7A, a tip clearance T decreases, and in FIG. 7B, the tip clearance T increases. Even when the tip clearance T is changed by an orbiting movement, the tip seal 7 is pressed toward the tooth bottom side of the end plate 5a by the compressed fluid from the rear surface, and the tip seal 7 can follow the tooth bottom so as to seal the tooth bottom.

Figure 8:
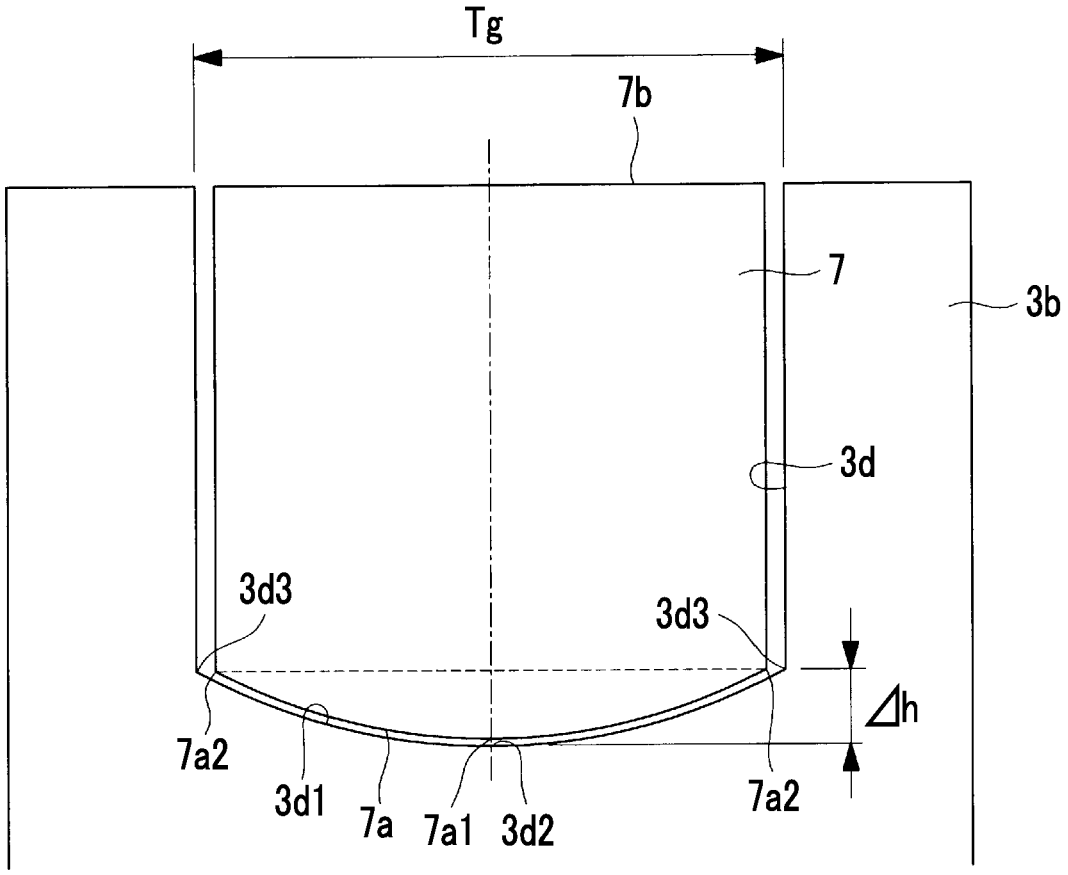
FIG. 8 is a horizontal sectional view around a tooth tip in a wall inclined portion.

FIG. 8 is a horizontal sectional view around the tooth tip when viewed from a sectional plane of the wall inclined portion 3b1 orthogonal in the spiral direction. In other words, FIG. 8 is a horizontal sectional view around the tooth tip when the wall inclined portion 3b1 from the wall inclined connection portion 3b4 on the inner peripheral side shown in FIG. 5 to the wall inclined connection portion 3b5 on the outer peripheral side shown in FIG. 5 is cut in a direction perpendicular to a paper surface. In addition, the tooth tip and the tip seal 7 of the orbiting scroll 5 are similarly configured.

As shown in FIG. 8, the tip seal 7 is accommodated in the tip seal groove 3d formed on a tip of the wall 3b. A bottom portion (lower surface) 7a of the tip seal 7 has an arc shape in which a center portion 7a1 in a width direction protrudes toward a groove bottom 3d1 side (downward) from both side portions 7a2. A tip surface (upper surface) 7b of the tip seal 7 is a flat surface. Accordingly, a cross section of the tip seal 7 is formed in a shape of a turtle. A horizontal cross section of the tip seal 7 formed in the shape of a turtle is formed over the entire wall inclined portion 3b1.

The groove bottom 3d1 of the tip seal groove 3d has a shape in which a center portion 3d2 in the width direction is deepest. The center portion 3d2 of the groove bottom 3d1 is deeper than both side portions 3d3 of the groove bottom 3d1 by a depression amount Δh.

Figure 9:
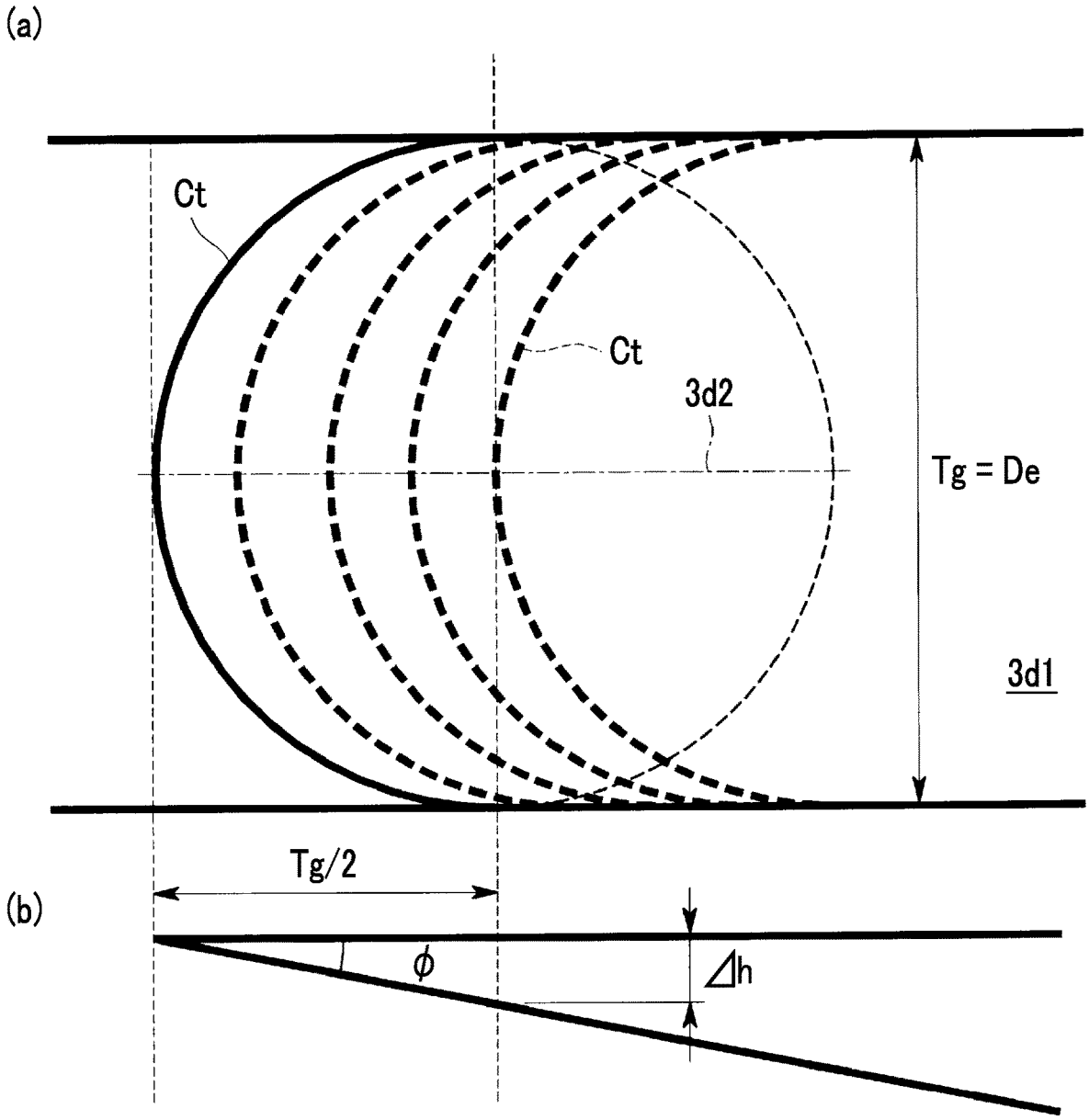
FIG. 9 is a view showing a groove bottom shape of the tip seal, (a) is a plan view of the groove bottom, and (b) is a schematic view showing a depth of a center portion of the groove bottom.

As shown in FIG. 9, the above-described shape of the groove bottom 3d1 of the tip seal groove 3d is generated by forming a contour line Ct. The contour line Ct has a groove width Tg of the tip seal groove 3d as a diameter and is formed in a semicircular arc which protrudes in a height increase direction (left side in FIG. 9) of the wall inclined portion 3b1. That is, a radius of the contour line Ct is Tg/2.

As can be seen from FIG. 9(b), the inclination of the wall inclined portion 3b1 is φ (refer to FIG. 5), and thus, the depression amount Δh of the center portion 3d2 of the groove bottom 3d1 from both side portions 3d3 is represented by the following Expression.

$$\Delta h=(Tg/2)\times\tan\varphi \quad (2)$$

Figure 10A:
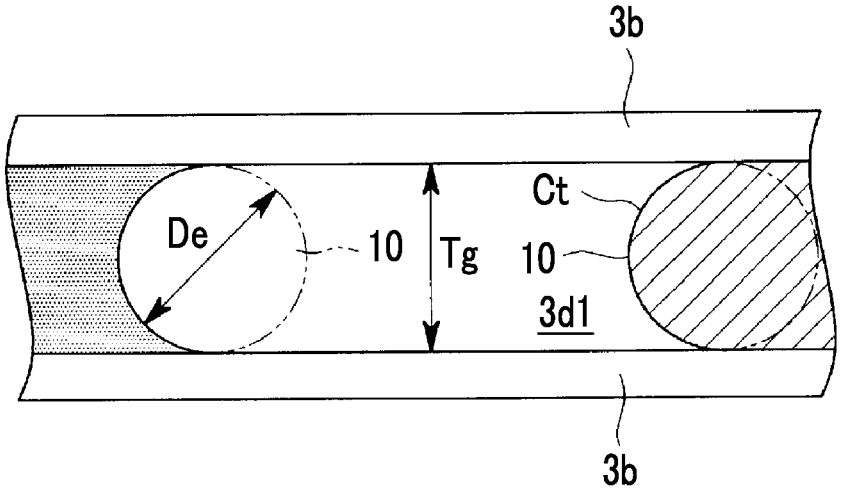
FIGS. 10A and 10B show a method for processing a tip seal groove.
Figure 10B:
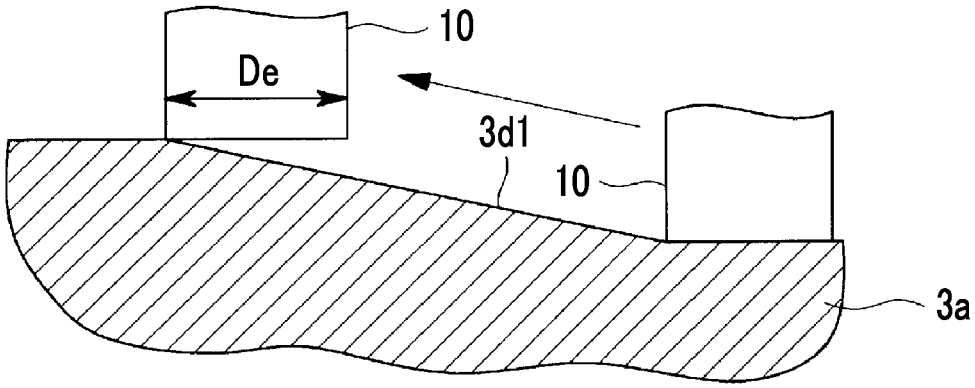
Figure 11:
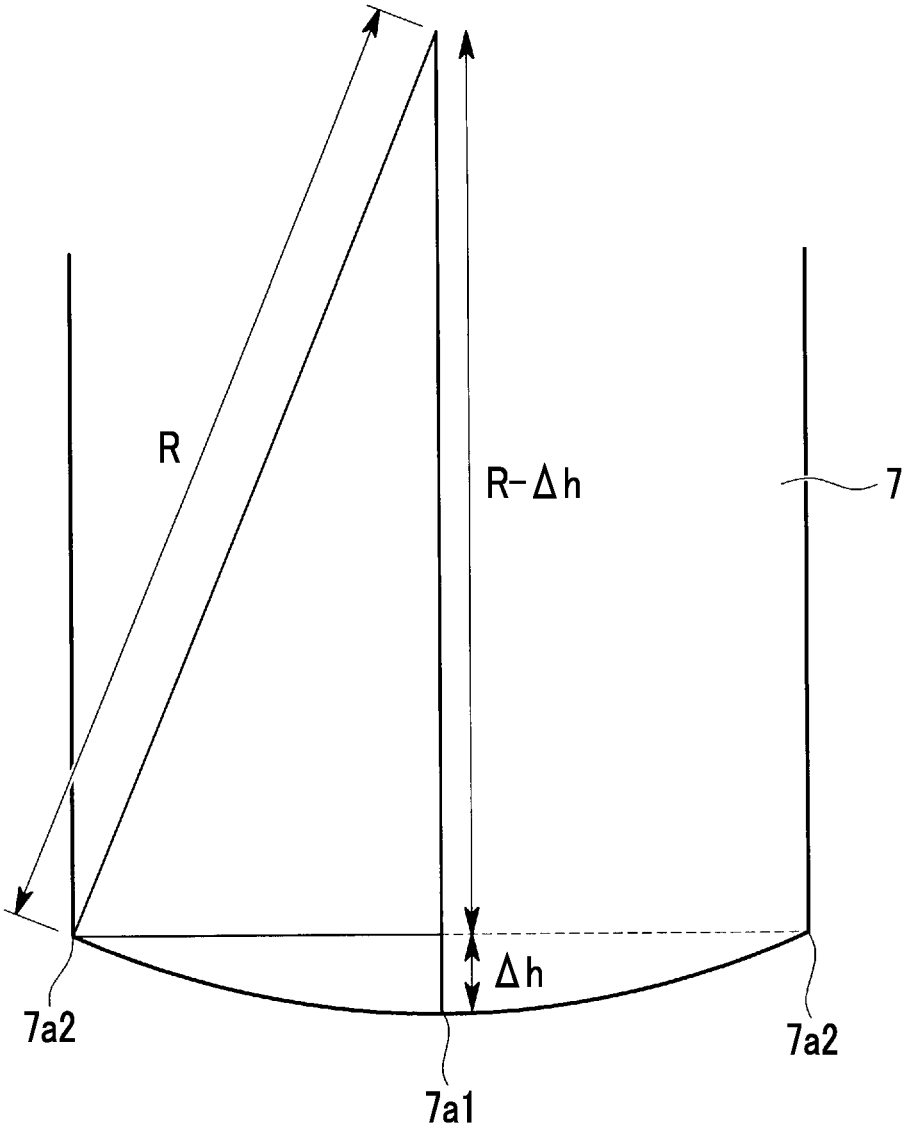
FIG. 11 is a horizontal sectional view of the tip seal.

The shape of the groove bottom 3d1 shown in FIG. 9(a) is obtained by processing an end mill 10 shown in FIGS. 10A and 10B. A diameter De of the end mill 10 is the same as the groove width Tg. By the end mill 10, the tip seal groove 3d is processed with one pass in one direction in which the inclination increases. The processing is performed such that a rotation axis of the end mill 10 is parallel to an axis passing through the center O1 (refer to FIG. 1A) of the fixed scroll 3. Accordingly, as shown in FIG. 9(a), the contour line Ct having a semicircular arc shape is formed.

As shown in FIG. 1 the bottom portion 7a of tip seal 7 is formed in an arc shape having a radius R so as to approximately coincide with the shape of the groove bottom 3d1. That is, the bottom portion 7a is formed in an arc shape having the radius R which passes through the center portion 7a1 protruding by the depression amount Δh from both side portions 7a2 and both side portions 7a2.

Figure 12:
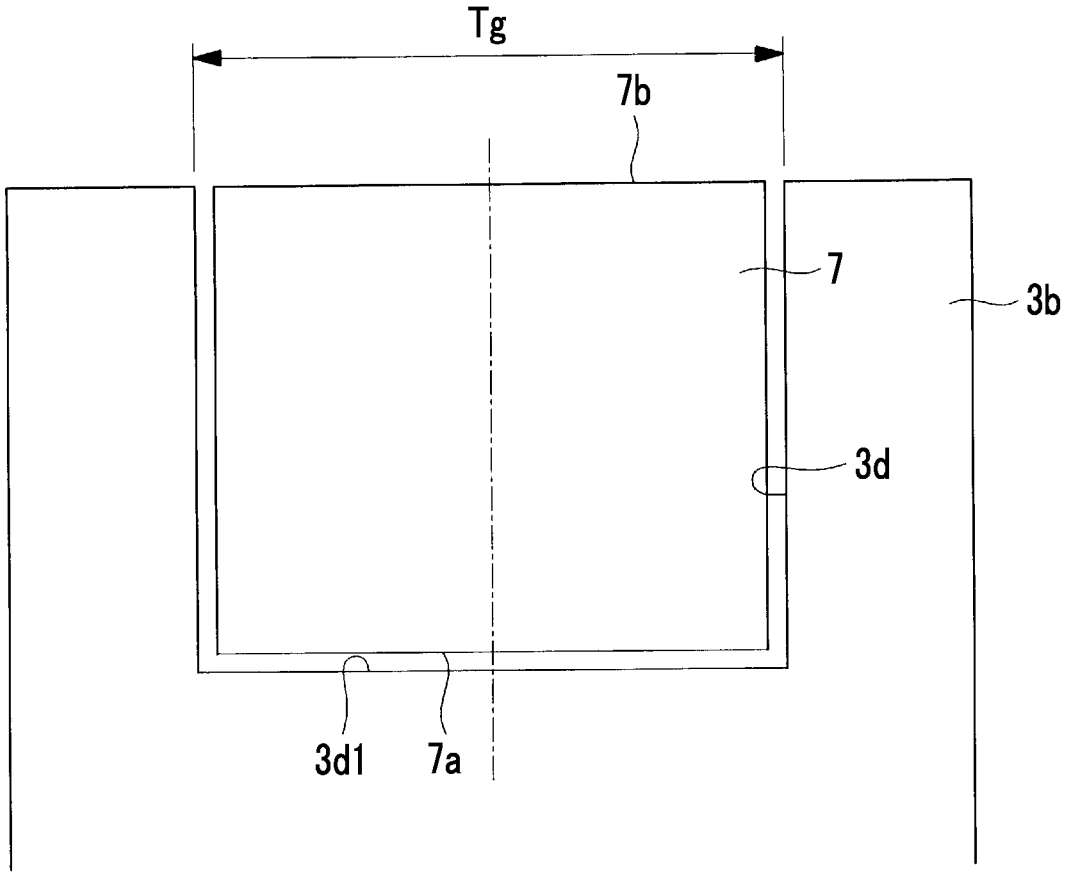
FIG. 12 is a horizontal sectional view around the tooth tip in the wall flat portion.

As shown in FIG. 12, in each of the wall flat portions 3b2 and 3b3, the groove bottom 3d1 of the tip seal groove 3d is flat. This is because each of the wall flat portions 3b2 and 3b3 is not inclined unlike the wall inclined portion 3b1, and thus, the flat surface is formed by processing of the end mill 10. Accordingly, the bottom portion 7a of the tip seal 7 is flat.

The above-described scroll compressor 1 is operated as follows.

The orbiting scroll 5 performs the revolution orbiting movement around the fixed scroll 3 by a drive source such as an electric motor (not shown). Accordingly, the fluid is sucked from the outer peripheral sides of the respective scrolls 3 and 5, and the fluid is taken into the compression chambers surrounded by the respective walls 3b and 5b and the respective end plates 3a and 5a. The fluid in the compression chambers is sequentially compressed while being moved from the outer peripheral side toward the inner peripheral side, and finally, the compressed fluid is discharged from a discharge port 3c formed in the fixed scroll 3. When the fluid is compressed, the fluid is compressed in the height directions of the walls 3b and 5b in the inclined portions formed by the end plate inclined portions 3a1 and 5a1 and the wall inclined portions 3b1 and 5b1, and thus, the fluid is three-dimensionally compressed.

According to the present embodiment, the following operational effects are exerted.

According to the tip seal 7 in which the center portion 7a1 in the width direction of the bottom portion 7a of the tip seal 7 protrudes from both side portions 7a2, clearance between the center portion 3d2 in the width direction of the groove bottom 3d1 and the center portion 7a1 in the width direction of the bottom portion 7a of the tip seal 7 decreases. Accordingly, a fluid leakage decreases, a function of the tip seal 7 is effectively exerted, and it is possible to improve performance of the scroll compressor 1.

In a case where the inclination in the spiral direction of the wall inclined portion 3b1 is defined as φ and the groove width of the tip seal groove 3d is defined as Tg, the depression amount Δh of the center portion 3d2 of the tip seal groove 3d with respect to both side portions 3d3 is (Tg/2)×tan φ. In order to correspond to this, the protrusion amount of the center portion 7a1 of the tip seal 7 is set to have the same dimension as the depression amount Δh. Accordingly, the clearance between the bottom portion 7a of the tip seal 7 and the groove bottom 3d1 can be made as small as possible. Particularly, the tip seal 7 is formed in a turtle shape so as to follow the shape of the groove bottom 3d1, and thus, the clearance can be further decreased.

In each of the wall flat portions 3b2 and 3b3, the groove bottom 3d1 of the tip seal groove 3d is a flat surface, and according to this, the bottom portion 7a of the tip seal 7 corresponding to the wall flat portions 3b2 and 3b3 also is a flat surface. Accordingly, the clearance between the groove bottom 3d1 and the bottom portion 7a of the tip seal 7 decreases, and the fluid leakage can be reduced.

In addition, in the present embodiment, the case is described in which the tip seal 7 is continuously connected from the inner peripheral side to the outer peripheral side. However, the tip seal 7 may be divided at a predetermined position in the spiral direction.

Figure 13:
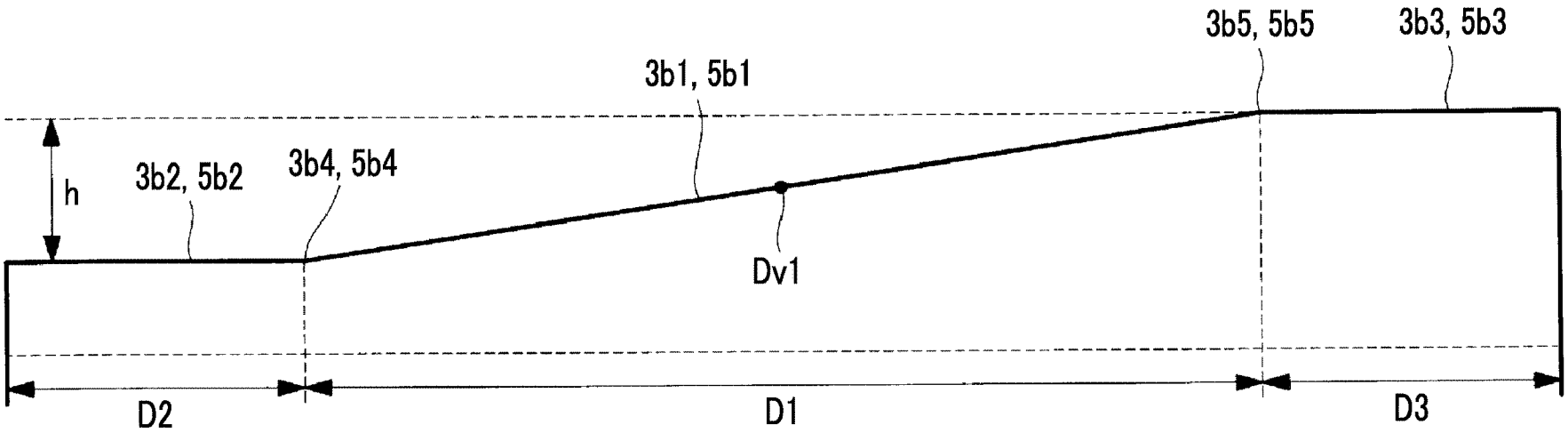
FIG. 13 shows the wall which is displayed to extend in the spiral direction and is a schematic view showing a division position of the tip seal.

For example, as shown in FIG. 13, the tip seal 7 may be divided into a plurality of portions at a predetermined division position Dv1 corresponding to the wall inclined portions 3b1 and 5b1. In addition, the division position is not limited to one location and may be a plurality of locations. Preferably, the division positions are provided at equal intervals.

In this way, the tip seal 7 is divided into a plurality of portions at the positions corresponding to the wall inclined portions 3b1 and 5b1, and thus, a deformation amount in a height direction (a direction indicated by a reference numeral h) of each divided tip seal can decrease. In this case, a so-called two-dimensional shaped tip seal can be adopted, in which a shape changed in a height direction in advance is not applied to each divided tip seal and each divided tip seal is flat.

In addition, the tip seal may be divided at the wall inclined connection portions 3b4, 3b5, 5b4, and 5b5 which connects the wall flat portions 3b2, 3b3, 5b2, and 5b3 and the wall inclined portions 3b1 and 5b1 to each other. Accordingly, the tip seal can be prevented from being damaged at a position at which the inclination is abruptly changed.

In addition, in the present embodiment, the end plate inclined portions 3a1 and 5a1 and the wall inclined portions 3b1 and 5b1 are provided on both scrolls 3 and 5. However, the end plate inclined portions 3a1 and 5a1 and the wall inclined portions 3b1 and 5b1 may be provided at any one of both scrolls 3 and 5.

Figure 14A:
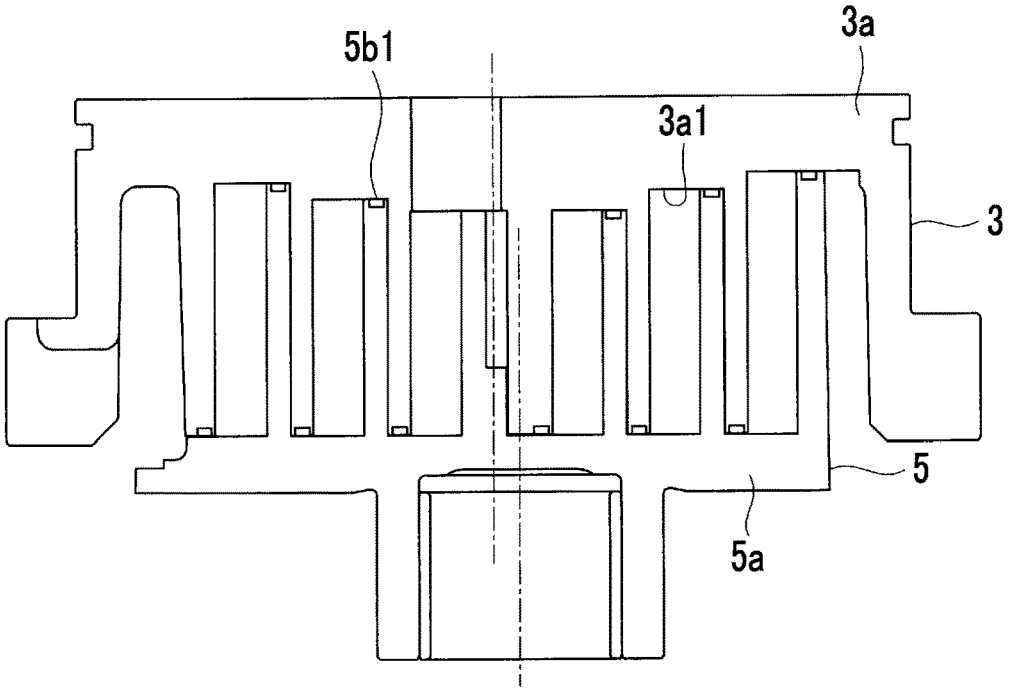
FIGS. 14A and 14B show a modification example.

Specifically, as shown in FIG. 14A, in a case where the wall inclined portion 5b1 is provided on the one wall (for example, orbiting scroll 5) and the end plate inclined portion 3a1 provided on the other end plate 3a, the other wall and the one end plate 5a may be flat.

Figure 14B:
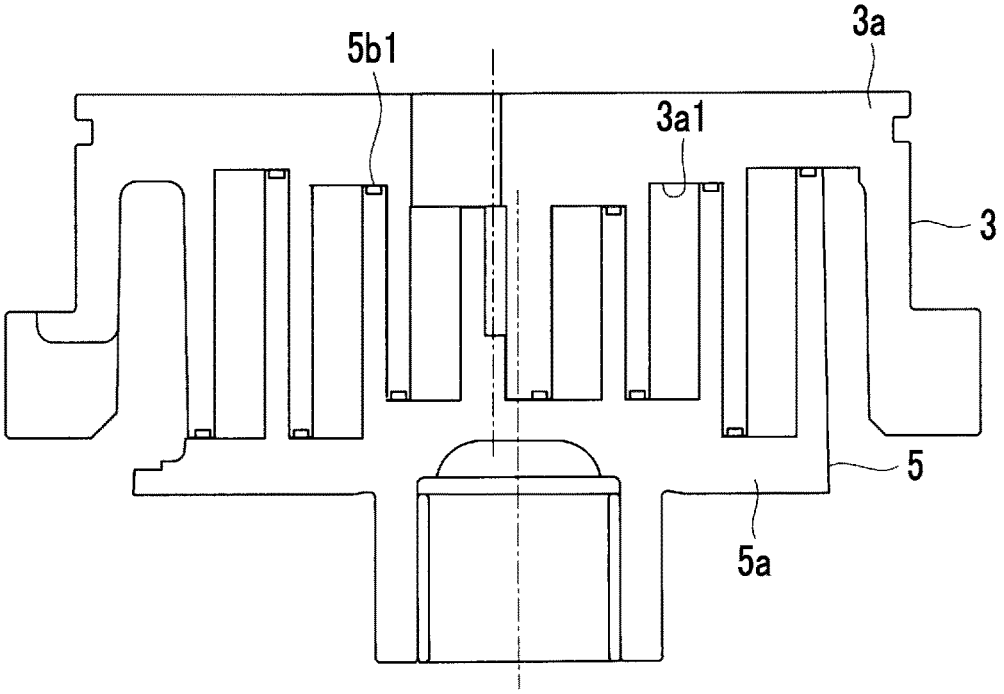

In addition, as shown in FIG. 14B, it may be combined with a stepped shape of the related art, that is, it may be combined with a shape in which a step portion is provided on the end plate 5a of the orbiting scroll 5 while the end plate inclined portion 3a1 is provided on the end plate 3a of the fixed scroll 3.

In the present embodiment, the wall flat portions 3b2, 3b3, 5b2, and 5b3 and the end plate flat portions 3a2, 3a3, 5a2, and 5a3 are provided. However, the flat portions on the inner peripheral side and/or the outer peripheral side may be omitted, and the inclined portion may be provided so as to extend to the entire walls 3b and 5b.

In the present embodiment, the scroll compressor is described. However, the present invention can be applied to a scroll expander which is used as an expander.

REFERENCE SIGNS LIST

1: scroll compressor (scroll fluid machine)
3: fixed scroll (first scroll member)
3a: end plate (first end plate)
3a1: end plate inclined portion
3a2: end plate flat portion (inner peripheral side)
3a3: end plate flat portion (outer peripheral side)
3a4: end plate inclined connection portion (inner peripheral side)
3a5: end plate inclined connection portion (outer peripheral side)
3b: wall (first wall)
3b1: wall inclined portion
3b2: wall flat portion (inner peripheral side)
3b3: wall flat portion (outer peripheral side)
3b4: wall inclined connection portion (inner peripheral side)
3b5: wall inclined connection portion (outer peripheral side)
3c: discharge port
3d: tip seal groove
3d1: groove bottom
3d2: center portion
3d3: side portion
5: orbiting scroll (second scroll member)
5a: end plate (second end plate)
5a1: end plate inclined portion
5a2: end plate flat portion (inner peripheral side)
5a3: end plate flat portion (outer peripheral side)
5a4: end plate inclined connection portion (inner peripheral side)
5a5: end plate inclined connection portion (outer peripheral side)
5b: wall (second wall)
5b1: wall inclined portion
5b2: wall flat portion (inner peripheral side)
5b3: wall flat portion (outer peripheral side)
5b4: wall inclined connection portion (inner peripheral side)
5b5: wall inclined connection portion (outer peripheral side)
7: tip seal
7a: bottom portion
7a1: center portion
7a2: side portion
7b: tip surface
10: end mill
Ct: contour line
Dv1: division position (of tip seal)
De: end mill diameter
L: inter-facing surface distance
T: tip clearance Tg: groove width (of tip seal groove)
φ: inclination
Δh: depression amount

The invention claimed is:

1. A scroll fluid machine comprising:

a first scroll member in which a spiral first wall is provided on a first end plate;

a second scroll member in which a spiral second wall is provided on a second end plate disposed to face the first end plate and the second wall meshes with the first wall such that the second scroll member performs a revolution orbiting movement relative to the first scroll member; and an inclined portion in which an inter-facing surface distance between the first end plate and the second end plate facing each other continuously decreases from outer peripheral sides of the first wall and the second wall toward inner peripheral sides thereof, wherein a groove portion formed on a tooth tip of each of the first wall and the second wall corresponding to the inclined portion is provided with a tip seal which comes into contact with a facing tooth bottom so as to seal a fluid, wherein a horizontal cross section of the groove portion in a direction orthogonal to a spiral direction of the first wall and the second wall is rectangular in shape and a groove bottom of the groove portion has an arc shape in which a center portion in a groove width direction is deepest, and wherein a horizontal cross section of the tip seal in the direction orthogonal to the spiral direction of the first wall and the second wall is rectangular in shape and a center portion of the tip seal in a width direction of a tip seal bottom portion facing the groove bottom protrudes from both side portions of the tip seal in an arc shape.

2. The scroll fluid machine according to claim 1, wherein in a case where an inclination in a spiral direction of the inclined portion is defined as φ and a groove width of the groove portion is defined as Tg, a protrusion amount Δh of the center portion of the tip seal with respect to both side portions of the tip seal is $(Tg/2)\times\tan\varphi$.

3. The scroll fluid machine according to claim 2, wherein a wall flat portion whose height is not changed is provided in an outermost peripheral portion and/or an innermost peripheral portion of each of the first wall and the second wall, wherein an end plate flat portion corresponding to the wall flat portion is provided in each of the first end plate and the second end plate, wherein the groove bottom of the groove portion corresponding to the end plate flat portion is a flat surface, and wherein in the tip seal corresponding to the end plate flat portion, the tip seal bottom portion is a flat surface.

4. The scroll fluid machine according to claim 2, wherein the tip seal is divided at a predetermined position in the spiral direction.

5. The scroll fluid machine according to claim 1, wherein a wall flat portion whose height is not changed is provided in an outermost peripheral portion and/or an innermost peripheral portion of each of the first wall and the second wall, wherein an end plate flat portion corresponding to the wall flat portion is provided in each of the first end plate and the second end plate, wherein the groove bottom of the groove portion corresponding to the end plate flat portion is a flat surface, and wherein in the tip seal corresponding to the end plate flat portion, the tip seal bottom portion is a flat surface.

6. The scroll fluid machine according to claim 5, wherein the tip seal is divided at a predetermined position in the spiral direction.

7. The scroll fluid machine according to claim 1, wherein the tip seal is divided at a predetermined position in the spiral direction.

8. A tip seal which is installed in a groove portion formed on a tooth tip of a spiral wall of a scroll fluid machine, wherein the wall includes an inclined portion whose height is continuously changed in a spiral direction, wherein a horizontal cross section of the groove portion in a direction orthogonal to a spiral direction of the first wall and the second wall is rectangular in shape and a groove bottom of the groove portion has an arc shape in which a center portion in a width direction is deepest, wherein a horizontal cross section of the tip seal in the direction orthogonal to the spiral direction of the first wall and the second wall is rectangular in shape, and wherein in a bottom portion of the tip seal facing the groove bottom, a center portion in a groove width direction protrudes from both side portions in an arc shape.

9. The tip seal which is installed in the groove portion formed on the tooth tip of the spiral wall of the scroll fluid machine, according to claim 8, wherein the tip seal is divided at a predetermined position in the spiral direction.

* * * * *